US011536487B2

(12) United States Patent
Zhang et al.

(10) Patent No.: US 11,536,487 B2
(45) Date of Patent: Dec. 27, 2022

(54) DIFFUSION MUFFLING DEVICE, DIFFUSION RESONANCE MUFFLING DEVICE, FULL-FREQUENCY DIFFUSION MUFFLING DEVICE, MUFFLING SYSTEM FOR VENTILATION CHANNEL, AND MUFFLING METHOD USING THE SAME

(71) Applicant: ZHENG SHENG ENVIRONMENTAL TECHNOLOGY CO., LTD., Chengdu (CN)

(72) Inventors: Xiaojie Zhang, Chengdu (CN); Lingfeng Gan, Chengdu (CN); Yuandong Wang, Chengdu (CN); Jian Kang, Chengdu (CN)

(73) Assignee: ZHENG SHENG ENVIRONMENTAL TECHNOLOGY CO., LTD., Chengdu (CN)

( * ) Notice: Subject to any disclaimer, the term of this patent is extended or adjusted under 35 U.S.C. 154(b) by 60 days.

(21) Appl. No.: 16/621,554

(22) PCT Filed: Apr. 17, 2019

(86) PCT No.: PCT/CN2019/082956
§ 371 (c)(1),
(2) Date: Dec. 11, 2019

(87) PCT Pub. No.: WO2020/042628
PCT Pub. Date: Mar. 5, 2020

(65) Prior Publication Data

US 2021/0404702 A1 Dec. 30, 2021

(30) Foreign Application Priority Data

Aug. 29, 2018 (CN) ..... 201810996138.X
Aug. 29, 2018 (CN) ..... 201810998332.1
Aug. 29, 2018 (CN) ..... 201810998335.5

(51) Int. Cl.
*F24F 13/24* (2006.01)
*G10K 11/162* (2006.01)
*G10K 11/172* (2006.01)

(52) U.S. Cl.
CPC ..... *F24F 13/24* (2013.01); *G10K 11/162* (2013.01); *G10K 11/172* (2013.01)

(58) Field of Classification Search
CPC ..... F24F 13/24; F24F 2013/245; F24F 2013/247; G10K 11/162; G10K 11/172
(Continued)

(56) References Cited

U.S. PATENT DOCUMENTS 2,270,825 A * 1/1942 Parkinson ..... G10K 11/161 73/147
2,759,554 A * 8/1956 Baruch ..... F24F 13/24 181/295
(Continued)

FOREIGN PATENT DOCUMENTS

CN 203518178 U * 4/2014
CN 203518178 U 4/2014
(Continued)

OTHER PUBLICATIONS

International Search Report and Written Opinion for PCT/CN2019/082956, dated Jul. 2, 2019.

*Primary Examiner* — Jeremy A Luks
(74) *Attorney, Agent, or Firm* — Billion & Armitage

(57) ABSTRACT

Embodiments of the present disclosure provide a diffusion muffling device, a diffusion resonance muffling device, a full-frequency diffusion muffling device, a muffling system for a ventilation channel, and a muffling method using the same, which include a plurality of diffusion muffling units disposed in the ventilation extension direction of the ventilation channel, wherein the plurality of diffusion muffling units are arranged in parallel in a direction with a predeter-
(Continued)

mined angle between the direction and the ventilation extension direction of the ventilation channel, and a muffling passage is formed between each two adjacent diffusion muffling units, wherein each of the diffusion muffling units includes at least one diffuser, and each diffuser includes a plurality of convex portions so that sound waves entering the muffling passage are reflected multiple times in the muffling passage by the plurality of convex portions and then sound is attenuated. In the present disclosure, the diffusers are disposed to diffuse and reflect sound waves, so that the sound is attenuated in a long and narrow passage by multiple times of reflections of the sound waves, thereby improving the low-frequency sound muffling performance in the ventilation channel so as to effectively achieve an effect of sound muffling and noise reduction in ventilation.

20 Claims, 8 Drawing Sheets

(58) Field of Classification Search
USPC ..... 181/224
See application file for complete search history.

(56) References Cited

U.S. PATENT DOCUMENTS 2,759,555 A * 8/1956 Baruch ..... G10K 11/172 181/203
2,759,556 A * 8/1956 Baruch ..... G10K 11/172 181/203
2,853,147 A * 9/1958 D Eustachio ..... G10K 11/172 181/224
2,950,776 A * 8/1960 Stephens ..... F24F 13/24 181/224
2,974,745 A * 3/1961 Kristiansen ..... F24F 13/24 181/224
2,994,401 A * 8/1961 Bourne ..... G10K 11/16 428/156
3,018,840 A * 1/1962 Bourne ..... E04B 1/86 181/224
3,019,850 A * 2/1962 March ..... F16L 9/003 181/224
3,113,634 A * 12/1963 Watters ..... F16L 55/0336 428/116
3,511,337 A * 5/1970 Pease ..... F02C 7/24 55/482
3,895,686 A * 7/1975 Savkar ..... G10K 11/161 181/224
4,243,117 A * 1/1981 Warnaka ..... G10K 11/172 181/292
4,287,962 A * 9/1981 Ingard ..... F02M 35/1272 181/268
5,696,361 A 12/1997 Chen
6,260,658 B1 * 7/2001 Darrell ..... F02C 7/045 181/224
7,258,196 B2 * 8/2007 Radatus ..... F24F 13/24 181/271
8,061,476 B2 * 11/2011 Corin ..... F01N 1/083 181/279
10,119,469 B2 * 11/2018 Ponyavin ..... G10K 11/161
2018/0238583 A1 8/2018 Jeong et al.

FOREIGN PATENT DOCUMENTS

CN 104949313 A 9/2015
CN 108458467 A 8/2018
CN 108800517 A 11/2018
CN 108800518 A 11/2018
CN 108831431 A 11/2018
CN 208936495 U 6/2019
CN 208936496 U 6/2019
CN 208938645 U 6/2019
KR 1020180134753 A 12/2018

* cited by examiner

DIFFUSION MUFFLING DEVICE, DIFFUSION RESONANCE MUFFLING DEVICE, FULL-FREQUENCY DIFFUSION MUFFLING DEVICE, MUFFLING SYSTEM FOR VENTILATION CHANNEL, AND MUFFLING METHOD USING THE SAME

CROSS-REFERENCE TO RELATED APPLICATIONS

The present disclosure claims priority to Chinese Patent Application No. 201810998332.1, filed with the Chinese Patent Office on Aug. 29, 2018, entitled "Diffusion Muffling Device and Muffling System for Ventilation Channel", Chinese Patent Application No. 201810996138.X, filed with the Chinese Patent Office on Aug. 29, 2018, entitled "Diffusion Resonance Muffling Device, and Muffling System for Ventilation Channel", and Chinese Patent Application No. 201810998335.5, filed with the Chinese Patent Office on Aug. 29, 2018, entitled "Full-frequency Diffusion Muffling Device and Muffling System for Ventilation Channel", the contents of which are incorporated herein by reference in their entirety.

TECHNICAL FIELD

The present disclosure relates to sound muffling in ventilation, and in particular, to a diffusion muffling device, a diffusion resonance muffling device, a full-frequency diffusion muffling device, a muffling system for a ventilation channel, and a muffling method using the same.

BACKGROUND

At present, in the technical field of sound muffling and noise reduction in ventilation, the installation of a muffler is the most common and effective treatment measure. In general, the muffler is a device that allows smooth passage of an air flow therethrough while effectively attenuating acoustic energy. Ventilation mufflers can be roughly divided into dissipative muffler, reactive muffler, impedance composite muffler, and ventilation pressure relief type muffler depending on their different muffling principles and structures. The dissipative muffler is a type of muffler most widely used in ventilation muffling systems. The dissipative muffler accomplishes the purpose of sound muffling by using the mechanism that acoustic energy is converted by friction into heat energy and dissipated when sound waves are transmitted through a sound absorbing material or structure.

The installation of dissipative mufflers is already very common in practical engineering applications. Common dissipative mufflers include sheet mufflers, matrix mufflers, folded plate type mufflers, and various derivative products, all of which are based on the muffling principle of accomplishing the purpose of sound muffling by using the sound absorptivity of fibrous porous sound absorbing materials. The inventors of the present disclosure have found in the study that such mufflers have the typical muffling characteristic that they have good muffling performance at medium frequency, but have poor muffling performance at low frequency bands due to the limitation brought by the fibrous porous sound absorbing materials. For high frequency bands, the dissipative muffler muffles a significantly reduced amount of sound at high frequency due to a phenomenon that the dissipative muffler has a failure at high frequency. For example, the inventors have found by tests that there is also a downward trend at the high frequency band, but sound muffling amount at high frequency can substantially meet the engineering requirements in practical engineering because the sound is attenuated fast with the distance at high frequency, however less noise is reduced at low and medium frequency bands, especially at the medium frequency band. How to improve the low-frequency sound muffling performance in the ventilation channel and effectively achieve the effect of sound muffling and noise reduction in ventilation is a technical problem urgently to be solved by those skilled in the art.

SUMMARY OF THE INVENTION

In order to solve at least one of the technical problems in the prior art, the objects of the present disclosure include providing a diffusion muffling device, a diffusion resonance muffling device, a full-frequency diffusion muffling device, a muffling system for a ventilation channel, and a muffling method using the same, to as to solve or alleviate the above problems.

In order to achieve at least one of the above objects, the following technical solutions are employed in embodiments of the present disclosure:

An embodiment of the present disclosure provides a diffusion muffling device, which is applicable to a ventilation channel, the diffusion muffling device comprising: a plurality of diffusion muffling units disposed in a ventilation extension direction of the ventilation channel, wherein the plurality of diffusion muffling units are arranged in parallel in a direction with a predetermined angle between the direction and the ventilation extension direction of the ventilation channel, a muffling passage is formed between each two adjacent diffusion muffling units, wherein each of the diffusion muffling units comprises at least one diffuser, and each of the diffusers comprises a plurality of convex portions so that sound waves entering the muffling passage are reflected for multiple times in the muffling passage by the plurality of convex portions and then sound is attenuated.

An embodiment of the present disclosure provides a diffusion resonance muffling device, comprising the diffusion muffling device described above, wherein in a width direction of the ventilation channel, in each diffusion muffling unit, each two of the diffusers constitute a diffusion resonance structure, wherein a convex portion on one diffuser of the diffusion resonance structure is a first convex portion, a convex portion on the other diffuser of the diffusion resonance structure is a second convex portion, and a plurality of first convex portions are spliced with a plurality of second convex portions in one-to-one correspondence to form cavities; in the ventilation extension direction of the ventilation channel, in the diffusion muffling unit, the plurality of diffusion resonance structures are sequentially connected to constitute a diffusion resonance muffling unit;

a muffling passage is formed between each two adjacent diffusion resonance muffling units, and sound waves entering the muffling passage are diffused and reflected for multiple times in the muffling passage by the plurality of first convex portions and second convex portions and resonantly absorbed by each of the cavities and then sound is attenuated.

Optionally, the predetermined angle is 90 degrees.

Optionally, the diffusion resonance structures are made a hard surface material, wherein the hard surface material includes one of glass fiber reinforced gypsum, glass fiber reinforced concrete, a wood material, and a particleboard material or a combination thereof.

Optionally, in the ventilation extension direction of the ventilation channel, each diffusion resonance muffling unit comprises at least two rows of diffusion resonance structures which are disposed from top to bottom and corresponding to each other, and the number of the diffusion resonance structures per row is at least two.

Optionally, each two adjacent diffusion resonance structures are fixedly connected by a metal gasketed bolt.

Optionally, each two adjacent diffusion resonance structures are fixed by a metal locking piece at edge regions of top ends and/or bottom ends of the respective diffusion resonance structures.

Optionally, both upper and lower ends of each diffusion resonance muffling unit are closed.

Optionally, each of the first convex portions or the second convex portions of each diffusion resonance structure has a protrusion height ranging from 25 mm to 250 mm.

Optionally, a distance between each two adjacent diffusion resonance muffling units ranges from 50 mm to 500 mm.

Optionally, each of the first convex portions and the corresponding second convex portion are bonded by a structural adhesive or bolted to form a corresponding cavity.

Optionally, the diffusion resonance muffling device further comprises fixing structures configured to fix a plurality of diffusion resonance muffling units arranged in parallel to the ventilation channel, wherein each fixing structure comprises a fixed rectangular tube, angle steels disposed on the fixed rectangular tube and configured to fix all the respective diffusion resonance muffling units to the fixed rectangular tube, and expansion bolts disposed at both ends of the fixed rectangular tube and configured to be fixed to both sides of the ventilation channel.

An embodiment of the present disclosure further provides a full-frequency diffusion muffling device, comprising the diffusion resonance muffling device described above, wherein a first perforated metal plate is disposed on an outside of the first convex portions of the diffusion resonance muffling device, and a second perforated metal plate is disposed on an outside of the second convex portions of the diffusion resonance muffling device.

In the embodiment, both a region between the first convex portions and the first perforated metal plate, and a region between the second convex portions and the second perforated metal plate are filled with a porous sound absorbing material, wherein the porous sound absorbing material, the first perforated metal plate, the second perforated metal plate, and the diffusion resonance structure jointly constitute a full-frequency diffusion muffling structure. In the ventilation extension direction of the ventilation channel, the full-frequency diffusion muffling structures in the same row jointly constitute a full-frequency diffusion muffling unit.

When sound waves enter the muffling passage, high-frequency sound is muffled by the porous sound absorbing material after the sound waves pass through the first perforated metal plate or the second perforated metal plate, and the sound waves are diffused and reflected for multiple times in the muffling passage by the plurality of first convex portions and second convex portions and resonantly absorbed by each of the cavities and then the sound is attenuated.

Optionally, the porous sound absorbing material is one of glass cotton, rock wool, slag wool, polyurethane foam, glass microballoon, and aeolian sand or a combination thereof.

Optionally, each of the first convex portions and/or the second convex portions of each full-frequency diffusion muffling structure has a thickness ranging from 5 mm to 50 mm.

Optionally, the full-frequency diffusion muffling device further comprises fixing structures configured to fixedly connect all the respective full-frequency diffusion muffling units to the ventilation channel, wherein each fixing structure comprises a contact portion, a first fixing portion and a second fixing portion disposed at two opposite ends of the contact portion, a plurality of first bolts, and a plurality of second bolts, wherein a first clamping portion is formed between the first fixing portion and one side surface of the contact portion and a second clamping portion is formed between the second fixing portion and the other side surface of the contact portion, and the first clamping portion and the second clamping portion are configured to clamp respective side ends of each of the full-frequency diffusion muffling units;

a plurality of first fixing holes are provided at the bottom of the first fixing portion, a plurality of second fixing holes are provided at the bottom of the second fixing portion, wherein each of the first bolts is fixed to the ventilation channel through the corresponding first fixing hole, and each of the second bolts is fixed to the ventilation channel through the corresponding second fixing hole to fix each of the full-frequency diffusion muffling units to the ventilation channel.

An embodiment of the present disclosure further provides another diffusion resonance muffling device, which is applicable to a ventilation channel, the diffusion resonance muffling device comprising: a plurality of diffusion resonance muffling units disposed in a ventilation extension direction of the ventilation channel, wherein the plurality of diffusion resonance muffling units are arranged in parallel in a direction with a predetermined angle between the direction and the ventilation extension direction of the ventilation channel, a muffling passage is formed between each two adjacent diffusion resonance muffling units, wherein each of the diffusion resonance muffling units comprises at least one diffusion resonance structure, each diffusion resonance structure comprising: a plurality of first convex portions and second convex portions disposed opposite to each other; each of the first convex portions is spliced with the corresponding second convex portion to form a corresponding cavity; when sound waves enter the muffling passage, the sound waves are diffused and reflected for multiple times in the muffling passage by the plurality of first convex portions and second convex portions and resonantly absorbed by each of the cavities and then the sound is attenuated.

An embodiment of the present disclosure further provides another full-frequency diffusion muffling device, which is applicable to a ventilation channel, the full-frequency diffusion muffling device comprising: a plurality of full-frequency diffusion muffling units disposed in a ventilation extension direction of the ventilation channel, wherein the plurality of full-frequency diffusion resonance muffling units are arranged in parallel in a direction with a predetermined angle between the direction and the ventilation extension direction of the ventilation channel, and a muffling passage is formed between each two adjacent full-frequency diffusion resonance muffling units; each of the full-frequency diffusion muffling units comprises at least one full-frequency diffusion muffling structure, each full-frequency diffusion muffling structure comprising: a first perforated metal plate; a second perforated metal plate; a plurality of first convex portions and second convex portions which are disposed opposite to each other and are disposed between the first perforated metal plate and the second perforated metal plate, wherein each of the first convex portions is spliced with the corresponding second convex portion to form a corresponding cavity; and a porous sound absorbing material filled in a region between the first convex portions and the first perforated metal plate and in a region between the second convex portions and the second perforated metal plate; when sound waves enter the muffling passage, high-frequency sound is muffled by the porous sound absorbing material after the sound waves sequentially pass through the first perforated metal plate and the second perforated metal plate, and then the sound waves are diffused and reflected for multiple times in the muffling passage by the plurality of first convex portions and second convex portions and resonantly absorbed by each of the cavities and then the sound is attenuated.

An embodiment of the present disclosure further provides a muffling system for a ventilation channel, comprising the diffusion muffling device described above, wherein the diffusion muffling device is mounted in the ventilation channel and configured to muffle sound waves entering the ventilation channel; or the muffling system comprising the diffusion resonance muffling device described above, wherein the diffusion resonance muffling device is mounted in the ventilation channel and configured to muffle sound waves entering the ventilation channel; or the muffling system comprising the full-frequency diffusion muffling device described above, wherein the full-frequency diffusion muffling device is mounted in the ventilation channel and configured to muffle sound waves entering the ventilation channel.

An embodiment of the present disclosure further provides a muffling method using the muffling system for a ventilation channel described above, in which a muffling process comprising steps of: sound waves entering the muffling system from an inlet of the ventilation channel and flowing through each muffling passage; diffusing and reflecting the sound waves by convex portions on both sides of the muffling passage; the sound waves flowing out from an outlet of the ventilation channel after being subjected to a noise reduction processing by the muffling passage.

Compared with the prior art, the present disclosure has the following advantageous effects:

The diffusion muffling device and the muffling system for a ventilation channel according to the embodiments of the present disclosure comprise a plurality of diffusion muffling units disposed in the ventilation extension direction of the ventilation channel, wherein the plurality of diffusion muffling units are arranged in parallel in a direction with a predetermined angle between the direction and the ventilation extension direction of the ventilation channel, and a muffling passage is formed between each two adjacent diffusion muffling units. Each of the diffusion muffling units comprises at least one diffuser, and each diffuser comprises a plurality of convex portions so that sound waves entering the muffling passage are reflected for multiple times in the muffling passage by the plurality of convex portions and then sound is attenuated. With such design, the use of fiberized materials is avoided, which is healthier and more environmentally friendly and effectively reduces the production cost. Moreover, the diffusers are provided to diffuse and reflect sound waves, so that the sound waves are reflected for multiple times in a passage similar to a dissipative muffler, whereby the sound can be attenuated in a long and narrow passage by the multiple times of reflections of the sound waves, thereby improving the low-frequency sound muffling performance in the ventilation channel so as to effectively achieve the effect of sound muffling and noise reduction in ventilation.

BRIEF DESCRIPTION OF DRAWINGS

In order to more clearly illustrate technical solutions of embodiments of the present disclosure, drawings required for use in the embodiments will be described briefly below. It is to be understood that the drawings below are merely illustrative of some embodiments of the present disclosure, and therefore should not be considered as limiting its scope. It will be understood by those of ordinary skill in the art that other relevant drawings can also be obtained from these drawings without any inventive effort.

Figure 1:
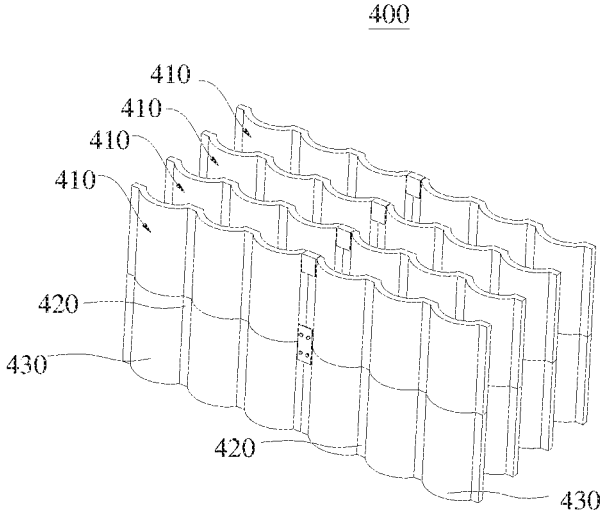
FIG. 1 is a schematic structural diagram of a diffusion muffling device according to an embodiment of the present disclosure.

Reference Numerals: 100—diffusion resonance muffling device; 110—diffusion resonance muffling unit; 120—diffusion resonance structure; 132—first convex portion; 134—second convex portion; 140—first fixing structure; 142—fixed rectangular tube; 144—angle steel; 146—expansion bolt; 150—metal gasketed bolt; 160—metal locking piece; 200—ventilation channel; 300—full-frequency diffusion muffling device; 310—full-frequency diffusion muffling unit; 320—full-frequency diffusion muffling structure; 321—first perforated metal plate; 322—second perforated metal plate; 323—porous sound absorbing material; 330—second fixing structure; 331—contact portion; 332—first fixing portion; 333—second fixing portion; 334—first bolt; 335—second bolt; 336—first fixing hole; 337—second fixing hole; 400—diffusion muffling device; 410—diffusion muffling unit; 420—diffuser; 430—convex portion.

DETAILED DESCRIPTION OF EMBODIMENTS

Please refer to FIG. 1, which is a schematic structural diagram of a diffusion muffling device 400 according to an embodiment of the present disclosure. In this embodiment, the diffusion muffling device 400 may be used in the field of sound muffling in ventilation, and for example may be mounted in a ventilation channel to achieve sound muffling and noise reduction in the ventilation channel. Evidently, it can be understood that those skilled in the art may also apply the diffusion muffling device 400 to any other enclosed space according to actual requirements.

As shown in FIG. 1, the diffusion muffling device 400 may comprise a plurality of diffusion muffling units 410 (only four are shown in FIG. 1) disposed in a ventilation extension direction of the ventilation channel, wherein the plurality of diffusion muffling units 410 are arranged in parallel in a direction with a predetermined angle between the direction and the ventilation extension direction of the ventilation channel, and a muffling passage is formed between each two adjacent diffusion muffling units 410. Each of the diffusion muffling units 410 comprises at least one diffuser 420 (only two are shown in FIG. 1), and each diffuser 420 comprises a plurality of convex portions 430 (only three are shown in FIG. 1) so that sound waves entering the muffling passage are reflected for multiple times in the muffling passage by the plurality of convex portions 430 and then the sound is attenuated.

It can be understood that the specific number of each of the diffusion muffling units 410, the diffusers 420, and the convex portions 430 described above may be flexibly set according to actual requirements, and is not specifically limited in this embodiment.

Based on the design described above, in this embodiment, diffuser structures are employed to avoid the use of fiberized materials, which is healthier and more environmentally friendly and effectively reduces the production cost. Moreover, the diffusers are provided to diffuse and reflect sound waves, so that the sound waves are reflected for multiple times in a passage similar to a dissipative muffler, whereby the sound can be attenuated in a long and narrow passage by the multiple times of reflection of the sound waves, thereby improving the low-frequency sound muffling performance in the ventilation channel so as to effectively achieve the effect of sound muffling and noise reduction in ventilation.

Figure 2:
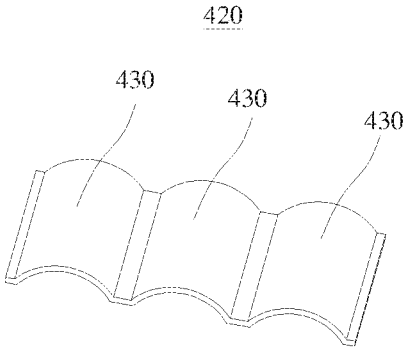
FIG. 2 is a first schematic structural diagram of a diffuser according to an embodiment of the present disclosure.
Figure 3:
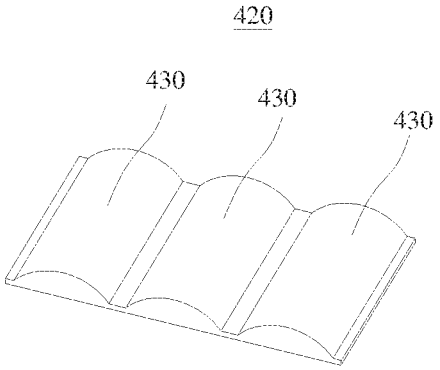
FIG. 3 is a second schematic structural diagram of a diffuser according to an embodiment of the present disclosure.
Figure 4:
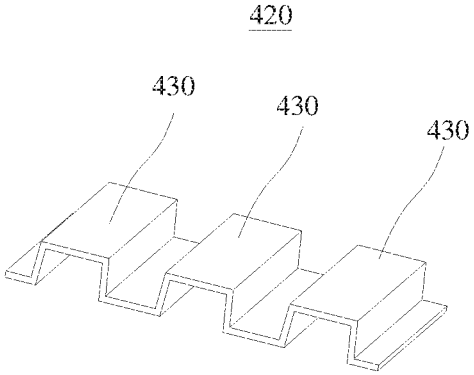
FIG. 4 is a third schematic structural diagram of a diffuser according to an embodiment of the present disclosure.
Figure 5:
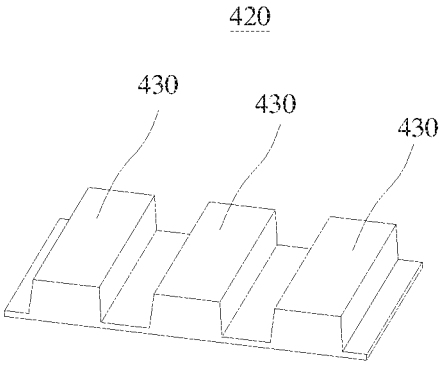
FIG. 5 is a fourth schematic structural diagram of a diffuser according to an embodiment of the present disclosure.
Figure 6:
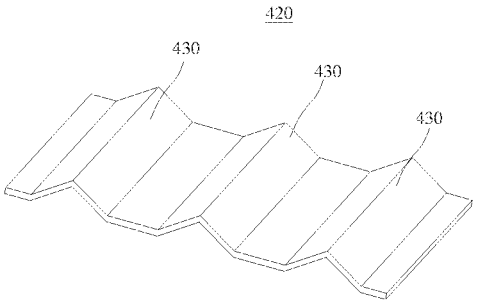
FIG. 6 is a fifth schematic structural diagram of a diffuser according to an embodiment of the present disclosure.
Figure 7:
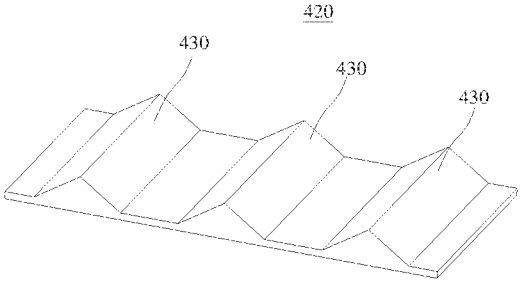
FIG. 7 is a sixth schematic structural diagram of a diffuser according to an embodiment of the present disclosure.

Optionally, the shape of each convex portion 430 of the diffuser 420 may be set according to the actual scenario requirements of the ventilation channel. For example, referring to FIG. 2, a semi-cylinder having a cavity may be used. For another example, referring to FIG. 3, a solid semi-cylinder may be used. For another example, referring to FIG. 4, a rectangular body having a cavity may be used. For another example, referring to FIG. 5, a solid rectangular body may be used. For another example, referring to FIG. 6, a cone having a cavity may be used. For another example, referring to FIG. 7, a solid cone may be used. It can be understood that each of the convex portions 430 is not limited to the above several shapes in actual design.

Figure 8:
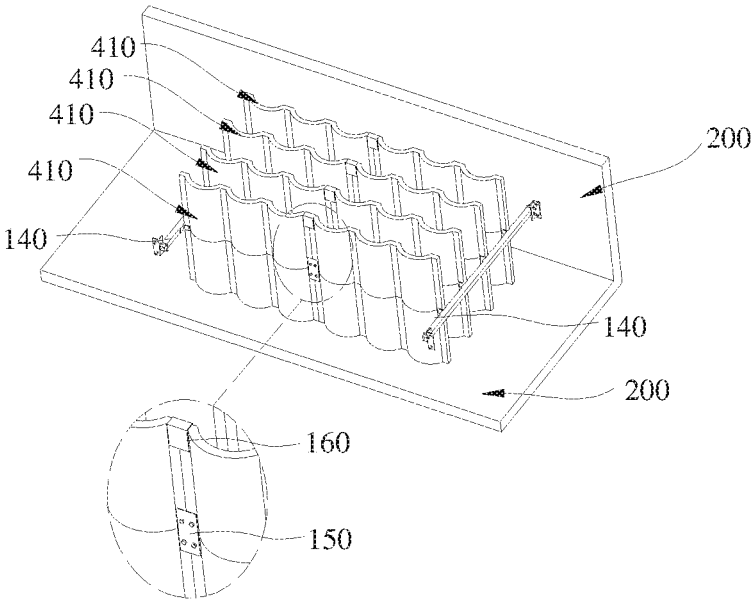
FIG. 8 is a first schematic diagram of a mounting structure of a diffusion muffling device according to an embodiment of the present disclosure.
Figure 9:
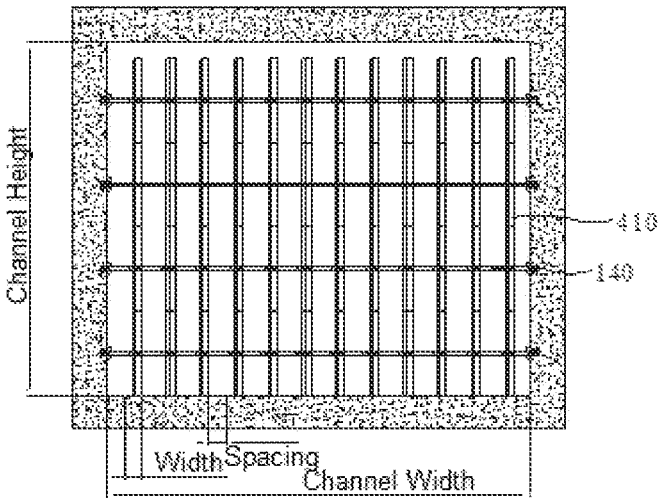
FIG. 9 is a second schematic diagram of a mounting structure of a diffusion muffling device according to an embodiment of the present disclosure.
Figure 10:
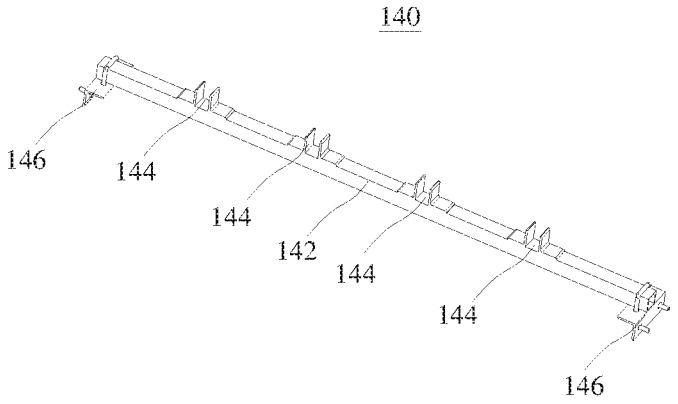
FIG. 10 is a schematic structural diagram of a first fixing structure shown in FIG. 8.

Optionally, referring to FIG. 8 to FIG. 10 in combination, the diffusion muffling device 400 may further comprise first fixing structures 140 (also referred to as fixing structures) for fixing the plurality of diffusion muffling units 410 arranged in parallel to the ventilation channel 200. Each first fixing structure 140 may comprise a fixed rectangular tube 142, angle steels 144 disposed on the fixed rectangular tube 142 and configured to fix all the respective diffusion muffling units 410 to the fixed rectangular tube 142, and expansion bolts 146 disposed at both ends of the fixed rectangular tube 142 and configured to be fixed to both sides of the ventilation channel 200. With this arrangement, each of the diffusion muffling units 410 can be fixed to the ventilation channel 200 so as to avoid a change in the arrangement position of the diffusion muffling device 400 under the action of the wind, which would affect the effect of sound muffling and noise reduction.

Figure 11:
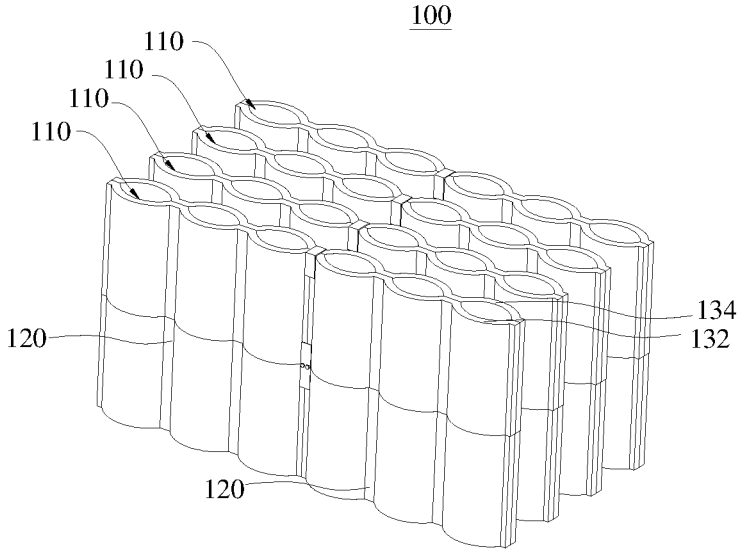
FIG. 11 is a schematic structural diagram of a diffusion resonance muffling device according to an embodiment of the present disclosure.

Please refer to FIG. 11, which is a schematic structural diagram of a diffusion resonance muffling device 100 according to an embodiment of the present disclosure. In this embodiment, the diffusion resonance muffling device 100 may be used in the field of sound muffling in ventilation, and for example may be mounted in a ventilation channel to achieve sound muffling and noise reduction in the ventilation channel. Evidently, it can be understood that the diffusion resonance muffling device 100 is also applicable to any other enclosed space according to actual requirements. Specifically, the diffusion resonance muffling device 100 may comprise the diffusion muffling device 410 described above. In the width direction of the ventilation channel 200, in each diffusion muffling unit 410, each two diffusers 420 constitute a diffusion resonance structure 120, the convex portion 430 on one diffuser 420 of the diffusion resonance structure 120 is a first convex portion 132, the convex portion 430 on the other diffuser 420 of the diffusion resonance structure 120 is a second convex portion 134, wherein the plurality of first convex portions 132 are spliced with the plurality of second convex portions 134 in one-to-one correspondence to form cavities; in the ventilation extension direction of the ventilation channel 200, in each diffusion muffling unit 410, the plurality of diffusion resonance structures 120 are sequentially connected to constitute a diffusion resonance muffling unit 110;

A muffling passage is formed between each two adjacent diffusion resonance muffling units 110, and sound waves entering the muffling passage are diffused and reflected for multiple times in the muffling passage by the plurality of first convex portions 132 and second convex portions 134 and resonantly absorbed by each of the cavities and then sound is attenuated.

That is to say, after the diffusers 420 constitute the diffusion resonance structures 120, the original diffusion muffling device 400 has the property of reducing noise by resonance. As shown in FIG. 11, the diffusion resonance muffling device 100 may comprise a plurality of diffusion resonance muffling units 110 (only four are shown in FIG. 11) disposed in the ventilation extension direction of the ventilation channel, wherein the plurality of diffusion resonance muffling units 110 are arranged in parallel in a direction with a predetermined angle between the direction and the ventilation extension direction of the ventilation channel, and a muffling passage is formed between each two adjacent diffusion resonance muffling units 110, wherein each of the diffusion resonance muffling units 110 comprises at least one diffusion resonance structure 120 (only two are shown in FIG. 11).

Each of the diffusion resonance structures 120 comprises a plurality of first convex portions 132 and second convex portions 134 disposed opposite to each other, wherein each of the first convex portions 132 is spliced with the corresponding second convex portion 134 to form a corresponding cavity, and sound waves entering the muffling passage are diffused and reflected for multiple times in the muffling passage by the plurality of first convex portions 132 and second convex portions 134 and resonantly absorbed by each of the cavities and then sound is attenuated.

It can be understood that the specific number of each of the diffusion resonance muffling units 110, the diffusion resonance structures 120, and the convex portions described above to be disposed may be flexibly set according to actual requirements and is not specifically limited in this embodiment.

Based on the design described above, in this embodiment, the diffusion resonance structures 120 are used so that it is unnecessary to use fiberized materials, which is healthier and more environmentally friendly and effectively reduces the production cost. Moreover, when sound waves enter the muffling passage, the sound waves may be diffused and reflected for multiple times in the muffling passage by the plurality of first convex portions 132 and second convex portions 134 and resonantly absorbed by each of the cavities and then the sound is attenuated, so that the low-frequency sound muffling performance in the ventilation channel can be improved so as to effectively achieve the effect of sound muffling and noise reduction in ventilation. If only the diffusers are disposed to muffle low-frequency sound waves, the diffusers are required to have a larger size. For example, in order to reduce sound at a frequency of about 200 Hz, the diffuser units are required to have a width dimension of about 1 m and have a dimension of at least greater than 0.15 m in the arch height direction, resulting in an increase in size of the diffusers, therefore such diffusers can be hardly applied to the ventilation system with limited actual space. In contrast, the diffusion resonance structures 120 according to this embodiment is equivalent to a mass-spring system and functions to absorb the energy of sound waves, has stronger low-frequency sound absorptivity than fibrous materials, can compensate for the insufficient sound absorptivity of the fibrous materials at low frequency, and also avoids the defect that the diffusion structures are required to have a large size when the low-frequency sound waves are absorbed merely by using diffusion structures.

In this embodiment, the distribution of the diffusion resonance structures 120 has an influence on the diffusion of sound, therefore the diffusion resonance muffling units 110 should be arranged in a direction such that the sound is transmitted sequentially through the first convex portions 132 and the second convex portions 134 of the respective diffusion resonance structures 120. Optionally, in this embodiment, the predetermined angle may be 90 degrees, that is to say, the plurality of diffusion resonance muffling units 110 may be arranged in parallel along a direction perpendicular to the ventilation extension direction of the ventilation channel. With this arrangement, the plurality of diffusion resonance muffling units 110 can more easily diffuse the sound waves, and also the arrangement space can be saved.

Optionally, the diffusion resonance structures 120 may be made of a hard surface material, wherein the hard surface material includes one of glass fiber reinforced gypsum, glass fiber reinforced concrete, a wood material, and a particleboard material or a combination thereof. Evidently, it can be understood that in other embodiments, it is not excluded that the diffusion resonance structures 120 be made of other hard surface materials, which is not specifically limited in this embodiment.

Figure 12:
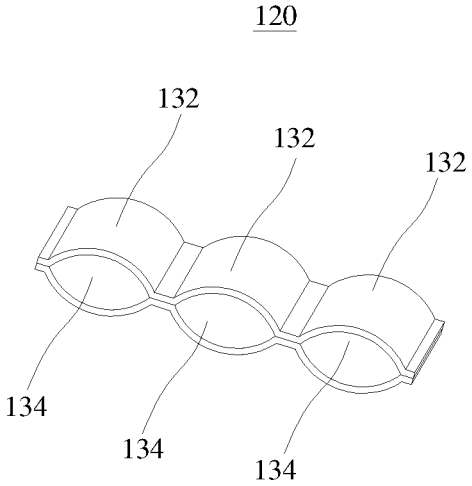
FIG. 12 is a first schematic structural diagram of a diffusion resonance structure according to an embodiment of the present disclosure.
Figure 13:
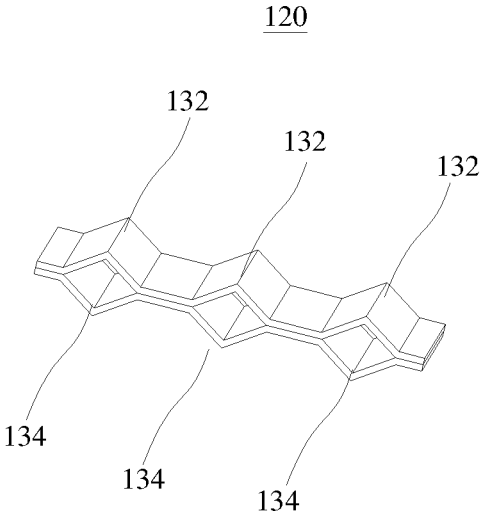
FIG. 13 is a second schematic structural diagram of a diffusion resonance structure according to an embodiment of the present disclosure.
Figure 14:
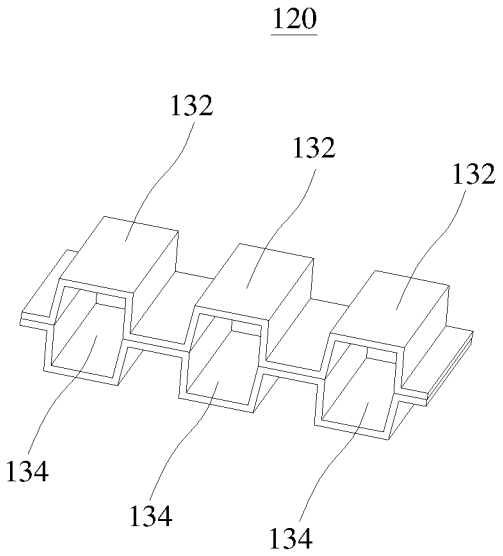
FIG. 14 is a third schematic structural diagram of a diffusion resonance structure according to an embodiment of the present disclosure.

Optionally, the shape of each first convex portion 132 or second convex portion 134 of each diffusion resonance structure 120 may be set according to the actual scenario requirements of the ventilation channel. For example, referring to FIG. 12, a cylinder may be used. For another example, referring to FIG. 13, a cone may be used. For another example, referring to FIG. 14, a rectangular body may be used. It can be understood that each first convex portion 132 or second convex portion 134 is not limited to the above several shapes in actual design.

Figure 15:
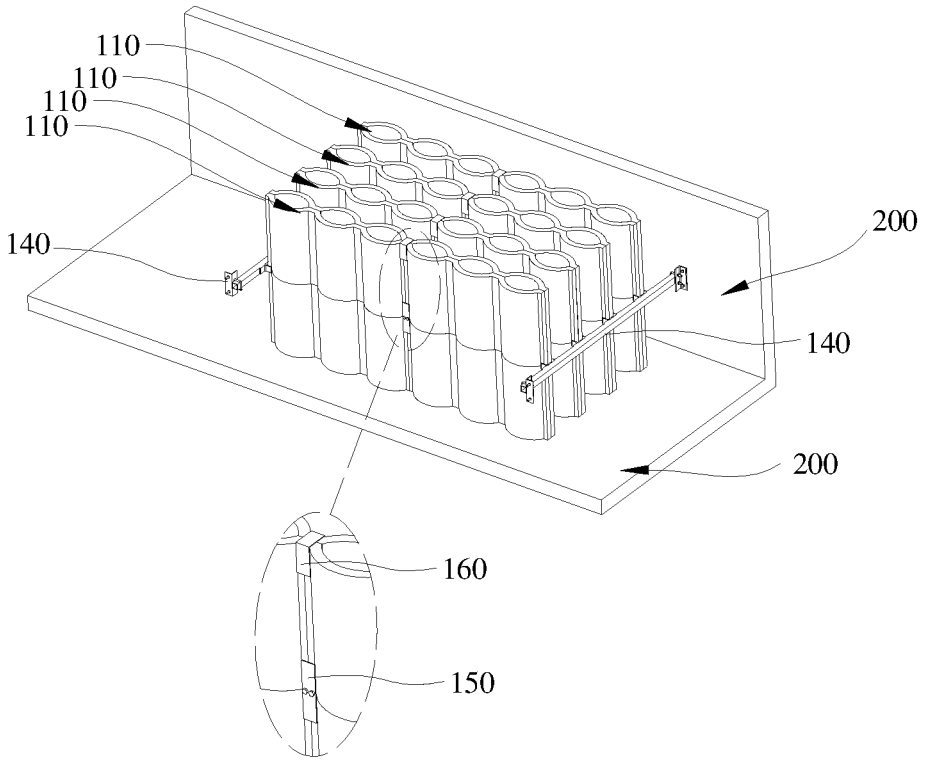
FIG. 15 is a schematic three-dimensional structural diagram of a diffusion resonance muffling device mounted in a ventilation channel according to an embodiment of the present disclosure.
Figure 16:
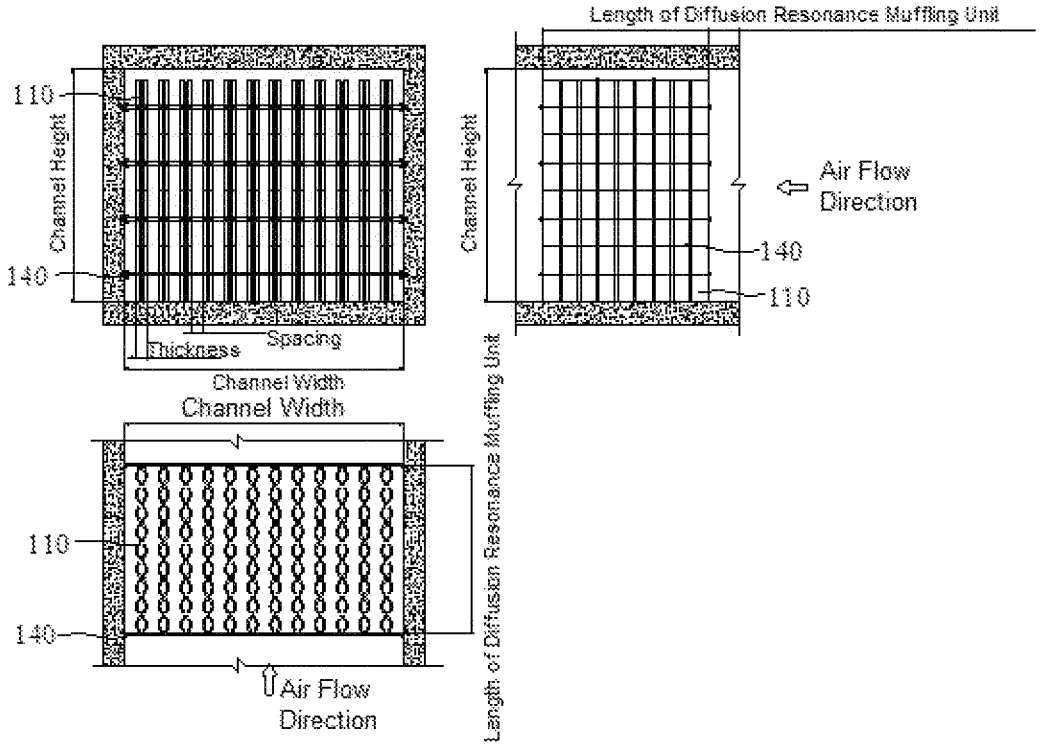
FIG. 16 illustrates three views of a diffusion resonance muffling device mounted in a ventilation channel according to an embodiment of the present disclosure.

In this embodiment, in the ventilation extension direction of the ventilation channel, each diffusion resonance muffling unit 110 comprises at least two rows of diffusion resonance structures 120 which are disposed from top to bottom and are corresponding to each other, and the number of the diffusion resonance structures per row is at least two. As shown in FIG. 15, the diffusion resonance muffling device 100 comprises four diffusion resonance muffling units 110, each of the diffusion resonance muffling units comprises two rows of diffusion resonance structures 120 disposed corresponding to each other from top to bottom, and the number of the diffusion resonance structures per row is two along the ventilation extension direction of the ventilation channel 200; or as shown in FIG. 16, the diffusion resonance muffling device 100 comprises twelve diffusion resonance muffling units 110, each of the diffusion resonance muffling units comprises eight rows of diffusion resonance structures 120 which are disposed from top to bottom and are corresponding to each other, and in the ventilation extension direction of the ventilation channel 200, the number of the diffusion resonance structures per row is three; and specifically, each diffusion resonance structure 120 comprises three first convex portions and three second convex portions arranged sequentially along its length. With the above arrangement, on the basis of achieving the length and height of the muffling passages in the diffusion resonance muffling device, the diffusion resonance structures which are the smallest constituent units of the diffusion resonance muffling device each has a small size which brings high convenience in production and processing, and an operator may assemble the plurality of diffusion resonance structures into diffusion resonance muffling devices with different lengths and heights according to the actual requirements so as to improve the convenience in use of the diffusion resonance muffling devices.

The inventors have found during the study that the size of each diffusion resonance structure 120 should be equivalent to the wavelength of incident sound waves in order to achieve effective sound diffusion, and the shape and size of the surface of each diffusion resonance structure 120 determine the diffusion frequency of the diffusion resonance muffling device 100. For example, the inventors have summarized the following empirical formulas from a large amount of test data to design the dimensions of the diffusion resonance structures 120:

$$2\pi f/c\ a \geq 4, b/a \geq 0.15$$

In the above formula, a is a width of each diffusion resonance structure 120; b is a protrusion height of each diffusion resonance structure 120; c is the sound velocity in the air; and f is the frequency of the sound waves. For example, the inventors have found by tests that when a=0.17 m, b=0.04 m, and the diffusion resonance muffling device 100 has a length of 3 m, with a ventilation rate of 50%. When the diffusion resonance structures 120 are made of aeolian sand, the following test results are obtained using the diffusion muffling device in which the diffuse structure is used alone:

sound is muffled by 0 to 10 dB at a frequency smaller than 800 Hz; sound is muffled by 10 to 20 dB at 800 Hz to 2,500 Hz; sound is muffled by more than 20 dB at 2,500 Hz to 6,300 Hz; and sound is muffled by 10 to 20 dB at 6,300 Hz to 10,000 Hz.

The following test results are obtained using the diffusion resonance muffling device 100 according to this embodiment:

sound is muffled by less than 10 dB at a frequency smaller than 315 Hz; sound is muffled by 10 to 20 dB at 315 Hz to 500 Hz; sound is muffled by more than 20 dB at 500 Hz to 6,300 Hz; and sound is muffled by 10 to 20 dB at 6,300 Hz to 10,000 Hz. As can be seen from comparison, the diffusion resonance muffling device 100 according to this embodiment shows a great improvement in low-frequency sound muffling performance and has a wider overall muffling frequency band as compared with the diffusion muffling device. In addition, the test results obtained by the inventors through actual experiments also show that, in practical applications, if each diffusion resonance muffling unit 110 has a larger length, a larger amount of sound is muffled, and if the first convex portions 132 or the second convex portions 134 of each diffusion resonance structure 120 each has a larger protrusion height b, the diffusion resonance structure 120 has a larger internal cavity and hence has stronger low-frequency sound muffling performance. Therefore, those skilled in the art can design the diffusion resonance muffling device 100 based on the above design thinking and the actual application scenarios.

As an implementation, before a ventilation channel is actually mounted, a single diffusion resonance structure 120 is firstly made, and the surface shape of each of first convex portions 132 and second convex portions 134 of the diffusion resonance structure 120 is determined according to the characteristics of an actual sound source and the requirement on noise reduction to make a plurality of diffusion resonance structures 120. Then, the plurality of diffusion resonance structures 120 may be sequentially arranged in a row to constitute a diffusion resonance muffling unit 110. The length direction thereof may be adjusted according to different requirements on noise reduction amount. The longer the length is, the larger the attenuation amount is. A spacing between the respective rows of the diffusion resonance muffling units 110 may be adjusted according to different requirements on noise reduction amounts. The smaller the spacing is, the larger the attenuation amount is. Finally, both upper and lower ends of the arranged diffusion resonance muffling unit 110 are closed, and muffling passages as shown in FIG. 11 similar to a dissipative muffler are formed between the different diffusion resonance muffling units 110. Here, in the actual mounting, a certain gap is left between the top of the diffusion resonance muffling device 100 and the top of the ventilation channel.

Optionally, each of the first convex portions 132 and the corresponding second convex portion 134 may be bonded by a structural adhesive or bolted to form a corresponding cavity.

Optionally, in this embodiment, each of the first convex portions 132 and the second convex portions 134 of each diffusion resonance structure 120 may have a protrusion height ranging from 25 mm to 250 mm. As an implementation, when the diffusion frequency has a lower limit of 200 Hz, each of the first convex portions 132 and the second convex portions 134 of the diffusion resonance structure 120 should have a protrusion height larger than 30 mm.

Optionally, in this embodiment, when the ventilation rate is 50%, a distance between each two adjacent diffusion resonance muffling units 110 may range from 50 mm to 500 mm.

Optionally, further referring to FIG. 15, in this embodiment, each two adjacent diffusion resonance structures 120 may be fixedly connected by a metal gasketed bolt 150. When there is only one row of the diffusion resonance muffling unit in the upward and downward (or vertical) direction, the metal gasketed bolt 150 connects two diffusion resonance structures adjacent in the length direction together; as shown in FIG. 11 or FIG. 15, when there are two or more rows of diffusion resonance muffling units in the upward and downward direction, the metal gasketed bolts 150 can simultaneously connect four adjacent, i.e., upper, lower, left, and right diffusion resonance structures together.

Optionally, still referring to FIG. 15, each two adjacent diffusion resonance structures 120 may be fixed by a metal locking piece 160 at edge regions of top ends and/or bottom ends thereof.

Optionally, referring to FIG. 15 in combination with FIG. 16, the diffusion resonance muffling device 100 may further comprise first fixing structures 140 which are configured to fix the plurality of diffusion resonance muffling units 110 arranged in parallel to the ventilation channel 200. Each first fixing structure 140 may comprise a fixed rectangular tube 142, angle steels 144 disposed on the fixed rectangular tube 142 and configured to fix all the respective diffusion resonance muffling units 110 to the fixed rectangular tube 142, and expansion bolts 146 disposed at both ends of the fixed rectangular tube 142 and configured to be fixed to both sides of the ventilation channel 200. With this arrangement, each of the diffusion resonance muffling units 110 can be fixed to the ventilation channel 200 so as to avoid a change in the arrangement position of the diffusion resonance muffling device 100 under the action of the wind, which would affect the effect of sound muffling and noise reduction.

Further, an embodiment of the present disclosure further provides a muffling system for a ventilation channel. The muffling system for a ventilation channel comprises the diffusion resonance muffling device 100 described above. The diffusion resonance muffling device 100 is mounted in the ventilation channel 200 and configured to muffle sound waves entering the ventilation channel 200.

In summary, the diffusion resonance muffling device and the muffling system for a ventilation channel according to the embodiments of the present disclosure comprise a plurality of diffusion resonance muffling units disposed in the ventilation extension direction of the ventilation channel, wherein the plurality of diffusion resonance muffling units are arranged in parallel in a direction with a predetermined angle between the direction and the ventilation extension direction of the ventilation channel, and a muffling passage is formed between each two adjacent diffusion resonance muffling units. Each of the diffusion resonance muffling units comprises at least one diffusion resonance structure constituted by a plurality of first convex portions and second convex portions disposed opposite to each other, and each of the first convex portions is spliced with the corresponding second convex portion to form a corresponding cavity. In this way, in the present disclosure, it is unnecessary to use fiberized materials, which is healthier and more environmentally friendly and effectively reduces the production cost. Moreover, when sound waves enter the muffling passage, the sound waves may be diffused and reflected for multiple times in the muffling passage by the plurality of first convex portions and second convex portions and resonantly absorbed by each of the cavities and then the sound is attenuated, so that the low-frequency sound muffling performance in the ventilation channel can be improved so as to effectively achieve the effect of sound muffling and noise reduction in ventilation. The resonance sound absorption structure provided in the present disclosure has stronger low-frequency sound absorptivity than fibrous materials, can compensate for the insufficient sound absorptivity of the fibrous materials at low frequency, and also avoids the defect that the diffusion resonance structures are required to have a larger size when the low-frequency sound waves are absorbed merely by using diffusion structures.

An embodiment of the present disclosure further provides a full-frequency diffusion muffling device 300, comprising the diffusion resonance muffling device 100 described above, wherein a first perforated metal plate 321 is disposed on the outside of the first convex portions 132 of the diffusion resonance muffling device 100, and a second perforated metal plate 322 is disposed on the outside of the second convex portions 134 of the diffusion resonance muffling device; and when sound waves enter the muffling passage, high-frequency sound is muffled sequentially by the first perforated metal plate or the second perforated metal plate, and then the sound waves are diffused and reflected for multiple times in the muffling passage by the plurality of first convex portions and second convex portions and resonantly absorbed by each of the cavities and then the sound is attenuated.

Further, both a region between the first convex portions and the first perforated metal plate, and a region between the second convex portions and the second perforated metal plate are filled with a porous sound absorbing material, and the porous sound absorbing material, the first perforated metal plate, the second perforated metal plate, and the diffusion resonance structure jointly constitute a full-frequency diffusion muffling structure; in the ventilation extension direction of the ventilation channel, the full-frequency diffusion muffling structures in the same row jointly constitute a full-frequency diffusion muffling unit; when the sound waves enter the muffling passages, the high-frequency sound is muffled by the porous sound absorbing material after passing through the first perforated metal plate or the second perforated metal plate.

Figure 17:
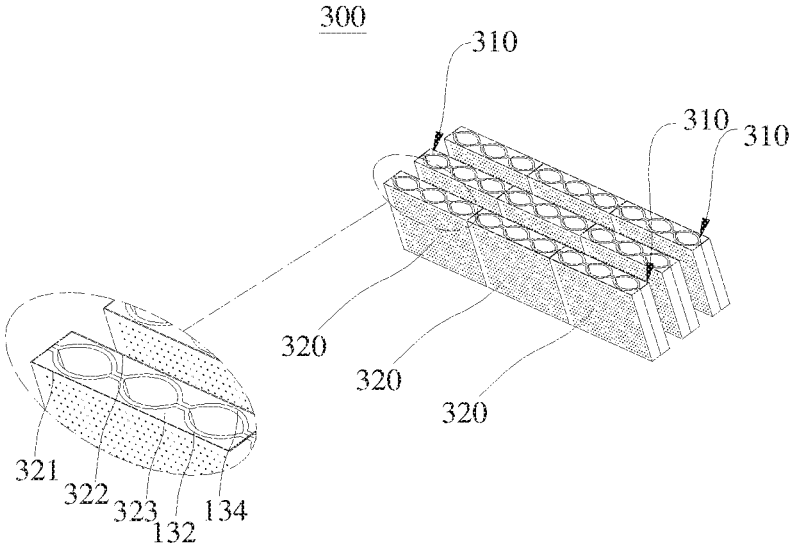
FIG. 17 is a schematic structural diagram of a full-frequency diffusion muffling device according to an embodiment of the present disclosure.

As shown in FIG. 17, the full-frequency diffusion muffling device may comprise a plurality of full-frequency diffusion muffling units (only three are shown in FIG. 17) disposed in the ventilation extension direction of the ventilation channel, wherein the plurality of full-frequency diffusion muffling units 310 are arranged in parallel in a direction at a predetermined angle with respective to the ventilation extension direction of the ventilation channel, and a muffling passage is formed between each two adjacent full-frequency diffusion muffling units 310.

In this embodiment, each full-frequency diffusion muffling unit 310 may comprise at least one full-frequency diffusion muffling structure 320 (only three are shown in FIG. 17), wherein each full-frequency diffusion muffling structure 320 comprises a first perforated metal plate 321, a second perforated metal plate 322, a plurality of first convex portions 132 and second convex portions 134 which are disposed opposite to each other and are disposed between the first perforated metal plate 321 and the second perforated metal plate 322, and a porous sound absorbing material 323 filled in a region between the first convex portions 132 and the first perforated metal plate 321 and a region between the second convex portions 134 and the second perforated metal plate 322, and each of the first convex portions 132 is spliced with the corresponding second convex portion 134 to form a corresponding cavity.

It can be understood that, in actual implementation, the specific number of each of the full-frequency diffusion muffling units 310, the full-frequency diffusion muffling structures 320, the first convex portions 132, and the second convex portions 134 may be set according to actual design requirements, and is not specifically limited in this embodiment.

During the actual application, when sound waves enter the muffling passage, sound is sequentially subjected to a primary muffling for medium-to-high frequencies by the porous first perforated metal plate 321 or second perforated metal plate 322; subsequently, the sound is subjected to a secondary muffling for medium-to-high frequencies by the porous sound absorbing material 323, and then the sound waves are diffused and reflected for multiple times in the muffling passage by the plurality of first convex portions 132 and second convex portions 134 and low-frequency sound is resonantly absorbed by each of the cavities and then the sound is attenuated at full frequencies.

With this design, in this embodiment, the diffusion theory is applied to the field of sound muffling, so that the low-frequency sound muffling capability can be effectively improved by using the first convex portions 132 and the second convex portions 134 of the full-frequency diffusion muffling structures 320, and the high-frequency sound muffling capability is improved by attaching a porous sound absorbing material 323, whereby an effect of full-frequency sound muffling is accomplished. If only the diffusers are provided to muffle low-frequency sound waves, there is a high requirement on the size of the diffusers. For example, in order to reduce sound at a frequency of about 200 Hz, the diffuser units are required to each have a width dimension of about 1 m and have a dimension of at least greater than 0.15 m in the arch height direction, resulting in an increase in size of the diffusers, and the diffusers can be hardly applied to a ventilation system with limited actual space. In contrast, the resonance sound absorption structure according to this embodiment constituted by the first convex portions 132 and the second convex portions 134 as well as the cavities formed thereby is equivalent to a mass-spring system and functions to absorb the energy of sound waves, has stronger low-frequency sound absorptivity than the fibrous materials, can compensate for the insufficient sound absorptivity of the fibrous materials at low frequency, and also avoids the defect that there is a high requirement on the size of the diffusion structures when the low-frequency sound waves are absorbed merely by using the diffusion structures. Moreover, although the resonant sound absorption structure used alone has a good sound absorption effect for low-frequencies, it has an insufficient sound absorption effect for medium-to-high frequencies. In this embodiment, the sound muffling capability for medium-to-high frequencies is further improved by attaching the porous sound absorbing material 323 to an external layer of the resonant sound absorption structure, whereby the purpose of full-frequency sound muffling is accomplished.

Further, a porous sound absorption structure is disposed around side portions of each diffusion muffling structure, wherein the porous sound absorption structure has a perforated metal plate thereon corresponding to the first convex portions which forms the first perforated metal plate; and the porous sound absorption structure has a perforated metal plate thereon corresponding to the second convex portions which forms the second perforated metal plate. Here, a specific form of the full-frequency diffusion muffling structure 320 is described. The full-frequency diffusion muffling structure is used as the smallest assembly unit of the full-frequency diffusion muffling device 300 and used as an independent component, and the operator can assemble a plurality of full-frequency diffusion muffling structures into full-frequency diffusion muffling devices with different heights and lengths according to actual requirements, which has high convenience in use and high convenience in production and processing.

In this embodiment, the distribution of the full-frequency diffusion muffling structures 320 has an influence on the diffusion of sound, therefore the full-frequency diffusion muffling units 310 should be arranged in a direction such that the sound is transmitted sequentially through the first convex portions 132 and the second convex portions 134 of the full-frequency diffusion muffling structures 320. Optionally, in this embodiment, the predetermined angle may be 90 degrees, that is to say, the plurality of full-frequency diffusion muffling units 310 may be arranged in parallel in a direction perpendicular to the ventilation extension direction of the ventilation channel. With this arrangement, the plurality of full-frequency diffusion muffling units 310 can more easily diffuse the sound waves, and also the arrangement space can be saved.

Optionally, the full-frequency diffusion muffling structures 320 may be made of a hard surface material, wherein the hard surface material includes one of glass fiber reinforced gypsum, glass fiber reinforced concrete, a wood material, and a particleboard material or a combination thereof. Evidently, it can be understood that in other embodiments, it is not excluded that the full-frequency diffusion muffling structures 320 be made of other hard surface materials, which is not specifically limited in this embodiment.

Optionally, the porous sound absorbing material 323 may be made of glass cotton, rock wool, slag wool, polyurethane foam, glass microballoon, aeolian sand, or any other porous sound absorbing material 323, which is not specifically limited herein. Here, when the porous sound absorbing material 323 is to be attached to the outside of the first convex portions 132 and the second convex portions 134, it may be either partially attached or entirely attached. The more the porous sound absorbing material 323 is attached, the more sound is muffled. As an implementation, the porous sound absorbing material 323 may be a particulate material.

Figure 18:
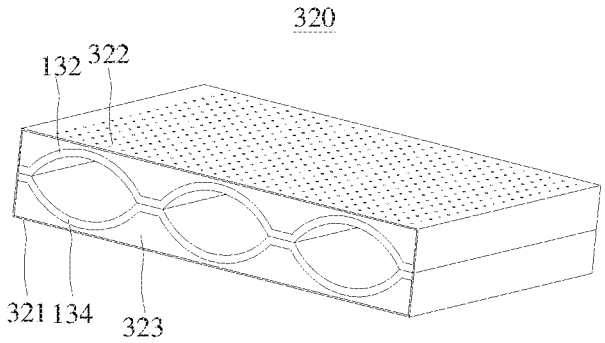
FIG. 18 is a first schematic structural diagram of a full-frequency diffusion muffling structure according to an embodiment of the present disclosure.
Figure 19:
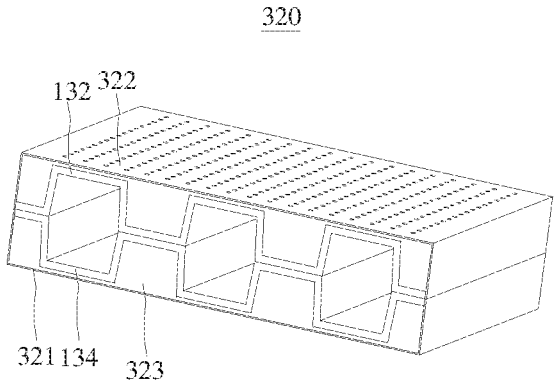
FIG. 19 is a second schematic structural diagram of a full-frequency diffusion muffling structure according to an embodiment of the present disclosure.
Figure 20:
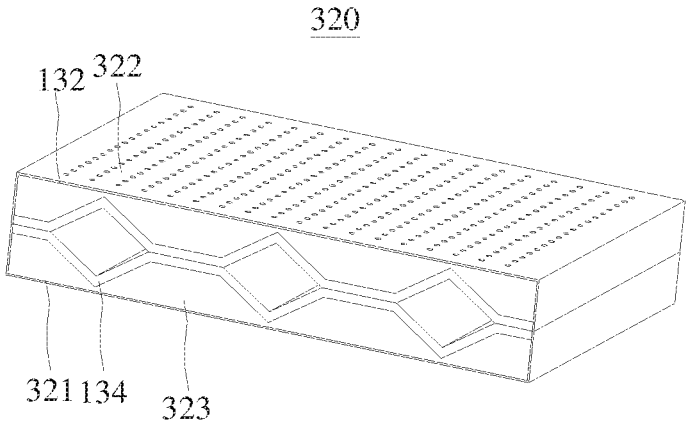
FIG. 20 is a third schematic structural diagram of a full-frequency diffusion muffling structure according to an embodiment of the present disclosure.

Optionally, the shape of each of the first convex portions 132 or the second convex portions 134 of each full-frequency diffusion muffling structure 320 may be set according to the actual scenario requirements of the ventilation channel. For example, referring to FIG. 18, a cylinder may be used. For another example, referring to FIG. 19, a rectangular body may be used. For another example, referring to FIG. 20, a cone may be used. It can be understood that each first convex portion 132 or second convex portion 134 is not limited to the above several shapes in actual design.

Similarly to the diffusion resonance muffling device 100, the size of each full-frequency diffusion muffling structure 320 should be equivalent to the wavelength of incident sound waves in order to achieve an effective sound diffusion, and the shape and size of the surface of the full-frequency diffusion muffling structure 320 determine the diffusion frequency of the full-frequency diffusion muffling device. For example, the inventors have summarized the following empirical formulas through a large amount of test data to design the dimensions of the full-frequency diffusion muffling structure 320:

$$2\pi f/c\ a_1 \geq 4, b_1/a_1 \geq 0.15$$

In the above formula, $a_1$ is a width of the full-frequency diffusion muffling structure 320; $b_1$ is a protrusion height of the full-frequency diffusion muffling structure 320; c is the sound velocity in the air; and f is the frequency of the sound wave. For example, the inventors have found by tests that when $a_1$=0.17 m, $b_1$=0.04 m, and the full-frequency diffusion muffling structure 320 has a length of 3 m, with a ventilation rate of 50%. When the full-frequency diffusion muffling structure 320 is made of aeolian sand, the following test results are obtained using the diffusion resonance muffling structure:

sound is muffled by less than 10 dB at a frequency smaller than 315 Hz; sound is muffled by 10 to 20 dB at 315 Hz to 500 Hz; sound is muffled by more than 20 dB at 500 Hz to 6,300 Hz; and sound is muffled by more than 20 dB at 6,300 Hz to 10,000 Hz.

The following test results are obtained using the full-frequency diffusion muffling structure 320 of this embodiment:

sound is muffled by less than 10 dB at a frequency smaller than 125 Hz; sound is muffled by 10 to 20 dB at 125 Hz to 250 Hz; sound is muffled by more than 20 to 30 dB at 250 Hz to 630 Hz; and sound is muffled by more than 30 dB at 630 Hz to 10,000 Hz.

As can be seen from comparison, the full-frequency diffusion muffling structure 320 according to this embodiment shows a small increase in low-frequency sound muffling performance and shows a significant improvement in medium-to-high frequency sound muffling performance as compared with the diffusion resonance muffling structure used alone. In addition, the inventors have found by tests that if the full-frequency resonance diffusion muffling structure has a larger length, or the first convex portions 132 or the second convex portions 134 have a larger protrusion height b, or there are larger internal cavities between the respective first convex portions 132 and the second convex portions 134, or a thicker porous sound absorbing material 323 is attached to the external layers thereof, the full-frequency diffusion muffling device has stronger sound muffling performance. Thus, those skilled in the art can design the full-frequency diffusion muffling device based on the above design thinking and the actual application scenarios.

For example, before a ventilation channel is actually mounted, a single first convex portion 132 and a single second convex portion 134 are firstly made, and the surface shape of each of the first convex portions 132 and the second convex portions 134 is determined according to the characteristics of an actual sound source and requirements on noise reduction. Then, the first convex portions 132 and the second convex portions 134 are spliced and connected by a structural adhesive, a porous sound absorbing material 323 is attached outside to form a full-frequency diffusion muffling structure 320. Then, the plurality of full-frequency diffusion muffling structures 320 are sequentially arranged in a row to constitute a full-frequency diffusion muffling unit 310. The length direction thereof may be adjusted according to different requirements on noise reduction amount. The longer the length is, the larger the attenuation amount is. The spacing between the respective rows may be adjusted according to different requirements on noise reduction. The smaller the spacing is, the larger the attenuation amount is. Finally, both upper and lower ends of the arranged full-frequency diffusion muffling unit 310 are closed to ensure the sealing of the cavities, and passages as shown in FIG. 17 similar to a dissipative muffler is formed between the different full-frequency diffusion muffling units 310.

In addition, the full-frequency diffusion muffling units 310 may be arranged in a block-building manner. In other words, the full-frequency diffusion muffling unit 310 at the bottom level is first mounted, and the full-frequency diffusion muffling units 310 are sequentially superimposed upward according to the height of the actual ventilation channel. The full-frequency diffusion muffling units 310 need to be fixed if they have a too large dimension in the height direction.

Optionally, each of the first convex portions 132 and the corresponding second convex portion 134 may be bonded by a structural adhesive or bolted to form a corresponding cavity.

Optionally, in this embodiment, each of the first convex portions 132 and the second convex portions 134 of each full-frequency diffusion muffling structure 320 may have a protrusion height ranging from 25 mm to 250 mm. As an implementation, when the diffusion frequency has a lower limit of 200 Hz, each of the first convex portions 132 and the second convex portions 134 of the full-frequency diffusion muffling structure 320 should have a protrusion height larger than 30 mm.

Optionally, in this embodiment, when the ventilation rate is 50%, the distance between each two adjacent full-frequency diffusion muffling units 310 may range from 50 mm to 500 mm.

Optionally, in this embodiment, each of the first convex portions 132 and the second convex portions 134 may have a thickness ranging from 5 mm to 50 mm, and different thicknesses are correspondingly selected when different materials are used therefor. As an implementation, each of the first convex portions 132 and the second convex portions 134 may have a thickness of 10 mm when they are made of aeolian sand.

Optionally, in this embodiment, each full-frequency diffusion muffling unit 310 may have a thickness ranging from 50 mm to 500 mm.

Figure 21:
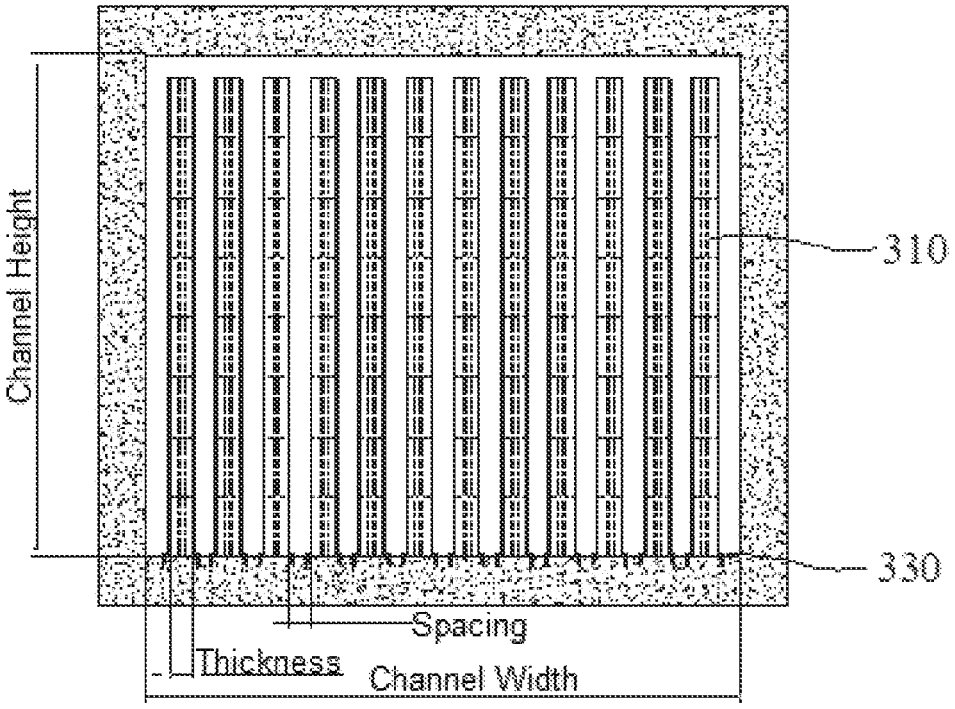
FIG. 21 is a schematic structural front view of a full-frequency diffusion muffling device mounted in a ventilation channel according to an embodiment of the present disclosure.
Figure 22:
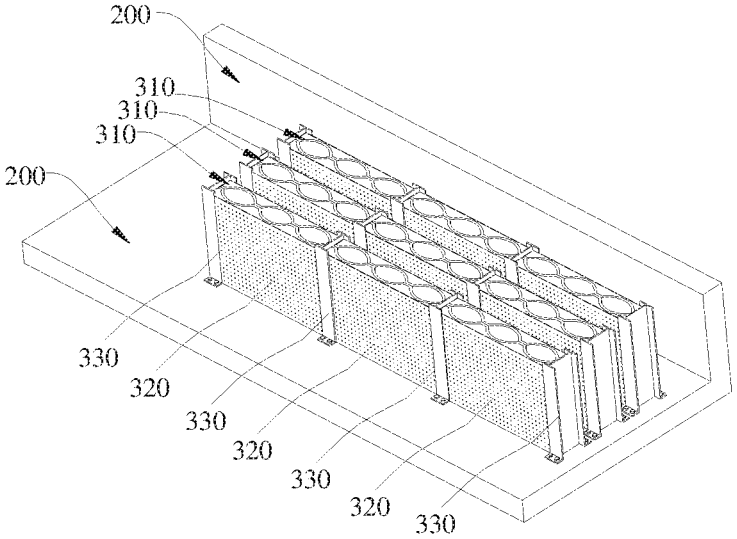
FIG. 22 is a schematic three-dimensional structural diagram of a full-frequency diffusion muffling device mounted in a ventilation channel according to an embodiment of the present disclosure.
Figure 23:
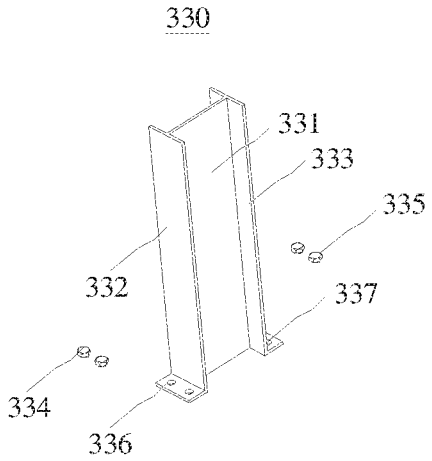
FIG. 23 is a schematic exploded structural view of a second fixing structure shown in FIG. 15.

Optionally, referring to FIG. 21 to FIG. 23 in combination, the full-frequency diffusion muffling device may further comprise second fixing structures 330 (also referred to as a fixing structure) for fixing each full-frequency diffusion muffling unit 310 to the ventilation channel 200. Each second fixing structure 330 may comprise a contact portion 331, a first fixing portion 332 and a second fixing portion 333 disposed at two opposite ends of the contact portion 331, a plurality of first bolts 334, and a plurality of second bolts 335, wherein a first clamping portion and a second clamping portion are respectively formed between the first fixing portion 332 as well as the second fixing portion 333 and two opposite side surfaces of the contact portion 331, and the first clamping portion and the second clamping portion are configured to clamp side ends of each full-frequency diffusion muffling unit 310. A plurality of first fixing holes 336 are provided at the bottom of the first fixing portion 332, a plurality of second fixing holes 337 are provided at the bottom of the second fixing portion 333, each of the first bolts 334 is fixed to the ventilation channel 200 through the corresponding first fixing hole 336, and each of the second bolts 335 is fixed to the ventilation channel 200 through the corresponding second fixing hole 337 so as to fix each full-frequency diffusion muffling unit 310 to the ventilation channel 200. With this arrangement, each of the full-frequency diffusion muffling units 310 can be fixed to the ventilation channel 200, and each two adjacent full-frequency diffusion muffling structures can be connected together so as to avoid a change in the arrangement position of the full-frequency diffusion muffling device 300 under the action of the wind, which would affect the effect of sound muffling and noise reduction.

The present embodiment further provides a muffling system for a ventilation channel, comprising the full-frequency diffusion muffling device described above, wherein the full-frequency diffusion muffling device is mounted in the ventilation channel and configured to muffle sound waves entering the ventilation channel.

Also provided is a muffling method, using the muffling system for a ventilation channel described above, in which the muffling process comprising steps of:

sound waves entering the muffling system from an inlet of the ventilation channel and flowing through each muffling passage;

diffusing and reflecting the sound waves by convex portions on both sides of the muffling passage;

the sound waves flowing out from an outlet of the ventilation channel after being subjected to a noise reduction processing by the muffling passage.

In summary, in the muffling system for a ventilation channel and the muffling method using the same according to the embodiments of the present disclosure, a plurality of full-frequency diffusion muffling units arranged in parallel are disposed in the ventilation extension direction of the ventilation channel, a muffling passage is formed between each two adjacent full-frequency diffusion muffling units, and each of the full-frequency diffusion muffling units comprises at least one full-frequency diffusion muffling structure. The full-frequency diffusion muffling structure comprises a first perforated metal plate, a second perforated metal plate, a plurality of first convex portions and second convex portions which are disposed opposite to each other and are disposed between the first perforated metal plate and the second perforated metal plate, and a porous sound absorbing material filled in a region between the first convex portions and the first perforated metal plate and a region between the second convex portions and the second perforated metal plate, and each of the first convex portions is spliced with the corresponding second convex portion to form a corresponding cavity. Thus, when sound waves enter the muffling passage, high-frequency sound is muffled by the porous sound absorbing material after the sound waves sequentially pass through the first perforated metal plate and the second perforated metal plate, and then the sound waves are diffused and reflected for multiple times in the muffling passage by the plurality of first convex portions and second convex portions and resonantly absorbed by each of the cavities and then the sound is attenuated, so that the low-frequency sound muffling capability is improved by using the full-frequency diffusion muffling structures, and the sound muffling capability for medium-to-high frequencies is improved by attaching the porous sound absorbing material, whereby the purpose of full-frequency sound muffling is accomplished.

The above description is merely illustrative of preferred embodiments of the present disclosure and is not intended to limit the present disclosure. It will be understood by those skilled in the art that various modifications and variations can be made to the present disclosure. Any modifications, equivalent alternatives, improvements and so on made within the spirit and principle of the present disclosure are to be included in the scope of protection of the present disclosure.

It is apparent to those skilled in the art that the present disclosure is not limited to the details of the exemplary embodiments described above, and the present disclosure may be implemented in other specific forms without departing from the spirit or essential features of the present disclosure. Therefore, the embodiments are to be considered in all aspects as illustrative and not restrictive, and the scope of the present disclosure is indicated by the appended claims, rather than by the above description. Therefore, all changes which come within the meaning and range of equivalency of the claims are to be embraced within the present disclosure. Any reference signs in the claims shall not be construed as limiting the claims involved.

INDUSTRIAL APPLICABILITY

The diffusion muffling device, the diffusion resonance muffling device, the full-frequency diffusion muffling device, the muffling system for a ventilation channel, and the muffling method using the same according to the present embodiments are small in size, healthy, and environmentally friendly, and have a good sound absorption effect for low-frequency noise.

What is claimed is:

1. A diffusion muffling device, which is applicable to a ventilation channel, the diffusion muffling device comprising:

a plurality of diffusion muffling units disposed in a ventilation extension direction of the ventilation channel, wherein the plurality of diffusion muffling units are arranged in parallel in a direction with a predetermined angle between the direction and the ventilation extension direction of the ventilation channel, a muffling passage is formed between each two adjacent diffusion muffling units, wherein each of the diffusion muffling units comprises at least one diffuser, and each of the at least one diffuser comprises a plurality of convex portions so that sound waves entering the muffling passage are reflected for multiple times in the muffling passage by the plurality of convex portions and then sound is attenuated, the diffusion muffling device further comprises fixing structures configured to fix the plurality of diffusion muffling units arranged in parallel to the ventilation channel, wherein each fixing structure comprises a fixed rectangular tube, angle steels which are disposed on the fixed rectangular tube and configured to fix all the respective diffusion muffling units to the fixed rectangular tube, and expansion bolts which are disposed at both ends of the fixed rectangular tube and configured to be fixed to both sides of the ventilation channel.

2. A diffusion resonance muffling device, comprising the diffusion muffling device according to claim 1, wherein in a width direction of the ventilation channel, in each diffusion muffling unit, each two of the diffusers constitute a diffusion resonance structure, wherein a convex portion on one diffuser of the diffusion resonance structure is a first convex portion, a convex portion on the other diffuser of the diffusion resonance structure is a second convex portion, and the plurality of first convex portions are spliced with the plurality of second convex portions in one-to-one correspondence to form cavities; in the ventilation extension direction of the ventilation channel, in the diffusion muffling unit, the plurality of diffusion resonance structures are sequentially connected to constitute a diffusion resonance muffling unit; and a muffling passage is formed between each two adjacent diffusion resonance muffling units, and sound waves entering the muffling passage are diffused and reflected for multiple times in the muffling passage by the plurality of first convex portions and the plurality of second convex portions and are resonantly absorbed by each of the cavities and then sound is attenuated.

3. The diffusion resonance muffling device according to claim 2, wherein the predetermined angle is 90 degrees.

4. The diffusion resonance muffling device according to claim 2, wherein each diffusion resonance structure is made of a hard surface material, wherein the hard surface material includes one of glass fiber reinforced gypsum, glass fiber reinforced concrete, a wood material, and a particleboard material or a combination thereof.

5. The diffusion resonance muffling device according claim 2, wherein in the ventilation extension direction of the ventilation channel, each diffusion resonance muffling unit comprises at least two rows of the diffusion resonance structures which are disposed from top to bottom and corresponding to each other, and the number of the diffusion resonance structures per row is at least two.

6. The diffusion resonance muffling device according to claim 2 wherein each two adjacent diffusion resonance structures are fixedly connected with each other by a metal gasketed bolt.

7. The diffusion resonance muffling device according to claim 2 wherein each two adjacent diffusion resonance structures are fixed with each other by a metal locking piece at edge regions of top ends and/or bottom ends of the respective diffusion resonance structures.

8. The diffusion resonance muffling device according to claim 2 wherein both upper and lower ends of each diffusion resonance muffling unit are closed.

9. The diffusion resonance muffling device according to claim 2 wherein each of the first convex portions and/or the second convex portions of each diffusion resonance structure has a protrusion height ranging from 25 mm to 250 mm.

10. The diffusion resonance muffling device according to claim 2 wherein a distance between the two adjacent diffusion resonance muffling units ranges from 50 mm to 500 mm.

11. The diffusion resonance muffling device according to claim 2 wherein each of the first convex portions and a corresponding second convex portion are bonded by a structural adhesive or bolted to form a corresponding cavity.

12. A full-frequency diffusion muffling device, comprising the diffusion resonance muffling device according to claim 2 wherein a first perforated metal plate is disposed on an outside of the first convex portions of the diffusion resonance muffling device, and a second perforated metal plate is disposed on an outside of the second convex portions of the diffusion resonance muffling device;

both a region between the first convex portions and the first perforated metal plate, and a region between the second convex portions and the second perforated metal plate are filled with a porous sound absorbing material, and the porous sound absorbing material, the first perforated metal plate, the second perforated metal plate, and the diffusion resonance structure jointly constitute a full-frequency diffusion muffling structure; in the ventilation extension direction of the ventilation channel, the full-frequency diffusion muffling structures in a same row jointly constitute a full-frequency diffusion muffling unit; and when sound waves enter the muffling passage, high-frequency sound is muffled by the porous sound absorbing material after sound waves pass through the first perforated metal plate or the second perforated metal plate, and the sound waves are diffused and reflected for multiple times in the muffling passage by the plurality of first convex portions and the plurality of second convex portions and resonantly absorbed by each of the cavities and then the sound is attenuated.

13. The full-frequency diffusion muffling device according to claim 12, wherein the porous sound absorbing material is one of glass cotton, rock wool, slag wool, polyurethane foam, glass microballon, and aeolian sand or a combination thereof.

14. The full-frequency diffusion muffling device according to claim 12, wherein each of the first convex portions and/or the second convex portions of each full-frequency diffusion muffling structure has a thickness ranging from 5 mm to 50 mm.

15. The full-frequency diffusion muffling device according to claim 12 further comprising fixing structures configured to fixedly connect each of the full-frequency diffusion muffling units to the ventilation channel, wherein each fixing structure comprises a contact portion, a first fixing portion and a second fixing portion disposed at two opposite ends of the contact portion, a plurality of first bolts, and a plurality of second bolts, wherein a first clamping portion is formed between the first fixing portion and one side surface of the contact portion and a second clamping portion is formed between the second fixing portion and the other side surface of the contact portion, and the first clamping portion and the second clamping portion are configured to clamp side ends of each of the full-frequency diffusion muffling units; and a plurality of first fixing holes are provided at bottom of the first fixing portion, a plurality of second fixing holes are provided at bottom of the second fixing portion, wherein each of the first bolts is fixed to the ventilation channel through a corresponding first fixing hole, and each of the second bolts is fixed to the ventilation channel through a corresponding second fixing hole to fix each of the full-frequency diffusion muffling units to the ventilation channel.

16. A muffling system for a ventilation channel, comprising the diffusion muffling device according to claim 1, wherein the diffusion muffling device is mounted in the ventilation channel and configured to muffle sound waves entering the ventilation channel.

17. A muffling method using the muffling system for a ventilation channel according to claim 16, in which a muffling process comprising steps of:

sound waves entering the muffling system from an inlet of the ventilation channel and flowing through the muffling passage;

diffusing and reflecting the sound waves by convex portions on both sides of each muffling passage; and the sound waves flowing out from an outlet of the ventilation channel after being subjected to a noise reduction processing by the muffling passage.

18. A muffling system for a ventilation channel, comprising the diffusion resonance muffling device according to claim 2, wherein the diffusion resonance muffling device is mounted in the ventilation channel and configured to muffle sound waves entering the ventilation channel.

19. A diffusion resonance muffling device, which is applicable to a ventilation channel, the diffusion resonance muffling device comprising:

a plurality of diffusion resonance muffling units disposed in a ventilation extension direction of the ventilation channel, wherein the plurality of diffusion resonance muffling units are arranged in parallel in a direction with a predetermined angle between the direction and the ventilation extension direction of the ventilation channel, a muffling passage is formed between each two adjacent diffusion resonance muffling units, wherein each of the diffusion resonance muffling units comprises at least one diffusion resonance structure, each of the at least one diffusion resonance structure comprising:

a plurality of first convex portions and a plurality of second convex portions which are disposed opposite to each other;

each of the first convex portions is spliced with a corresponding second convex portion to form a corresponding cavity; and when sound waves enter the muffling passage, the sound waves are diffused and reflected for multiple times in the muffling passage by the plurality of first convex portions and the plurality of second convex portions and are resonantly absorbed by each of the cavities and then the sound is attenuated, the diffusion resonance muffling device further comprises fixing structures configured to fix the plurality of diffusion resonance muffling units arranged in parallel to the ventilation channel, wherein each fixing structure comprises a fixed rectangular tube, angle steels which are disposed on the fixed rectangular tube and configured to fix all the respective diffusion resonance muffling units to the fixed rectangular tube, and expansion bolts which are disposed at both ends of the fixed rectangular tube and configured to be fixed to both sides of the ventilation channel.

20. A full-frequency diffusion muffling device, which is applicable to a ventilation channel, the full-frequency diffusion muffling device comprising:

a plurality of full-frequency diffusion muffling units disposed in a ventilation extension direction of the ventilation channel, wherein the plurality of full-frequency diffusion resonance muffling units are arranged in parallel in a direction with a predetermined angle between the direction and the ventilation extension direction of the ventilation channel, and a muffling passage is formed between each two adjacent full-frequency diffusion resonance muffling units;

each of the full-frequency diffusion muffling units comprises at least one full-frequency diffusion muffling structure, each of the at least one full-frequency diffusion muffling structure comprising:

a first perforated metal plate;

a second perforated metal plate;

a plurality of first convex portions and a plurality of second convex portions which are disposed opposite to each other and are disposed between the first perforated metal plate and the second perforated metal plate, each of the first convex portions is spliced with a corresponding second convex portion to form a corresponding cavity; and a porous sound absorbing material filled in a region between the first convex portions and the first perforated metal plate and in a region between the second convex portions and the second perforated metal plate;

when sound waves enter the muffling passage, high-frequency sound is muffled by the porous sound absorbing material after the sound waves sequentially pass through the first perforated metal plate and the second perforated metal plate, and then the sound waves are diffused and reflected for multiple times in the muffling passage by the plurality of first convex portions and the plurality of second convex portions and are resonantly absorbed by each of the cavities and then the sound is attenuated.

* * * * *